US006346688B1

(12) United States Patent
O'Donnell

(10) Patent No.: US 6,346,688 B1
(45) Date of Patent: Feb. 12, 2002

(54) GLOW PLUG WITH CRIMP-SECURED WASHER AND METHOD

(76) Inventor: Steven B. O'Donnell, 11435 Eberly Cir., Cerritos, CA (US) 90703

( * ) Notice: Subject to any disclaimer, the term of this patent is extended or adjusted under 35 U.S.C. 154(b) by 0 days.

(21) Appl. No.: 09/695,685

(22) Filed: Oct. 24, 2000

(51) Int. Cl.[7] ..... F23Q 7/00
(52) U.S. Cl. ..... 219/270; 123/145 A; 29/611
(58) Field of Search ..... 219/270, 544, 219/541; 123/145 A, 145 R; 29/611

(56) References Cited

U.S. PATENT DOCUMENTS

| | | | | |
|---|---|---|---|---|
| 4,418,661 A | | 12/1983 | Esper et al. | |
| 4,437,440 A | | 3/1984 | Suzuki et al. | |
| 5,589,091 A | * | 12/1996 | Muller | 219/270 |
| 5,834,736 A | | 11/1998 | Kawamura | |
| 6,248,980 B1 | * | 6/2001 | Chiu et al. | 219/270 |

* cited by examiner

*Primary Examiner*—John A. Jeffery
(74) *Attorney, Agent, or Firm*—Edgar W. Averill, Jr.

(57) ABSTRACT

A glow plug construction for use in internal combustion engines has an annular washer seated at an open upper end of an outer shell having a crimp portion extending to an upper rim. The annular washer has a ridge-like upper surface, with a preferably curved configuration. And the crimp portion of the outer shell is contouredly bent around the ridge-like upper surface with the upper rim extending past and below an apex of the annular washer. In this manner, the crimp portion exerts a substantial crimp pressure along the annular washer. Furthermore, a crimping method produces the crimped glow plug construction by gradually moving a crimping die against the crimp portion. The crimping die has a concave annular die such that, upon exertion of the preferably hydraulic crimping force, the crimp portion is plastically bent around the annular washer and the upper rim extends past and below the apex of the annular washer.

10 Claims, 2 Drawing Sheets

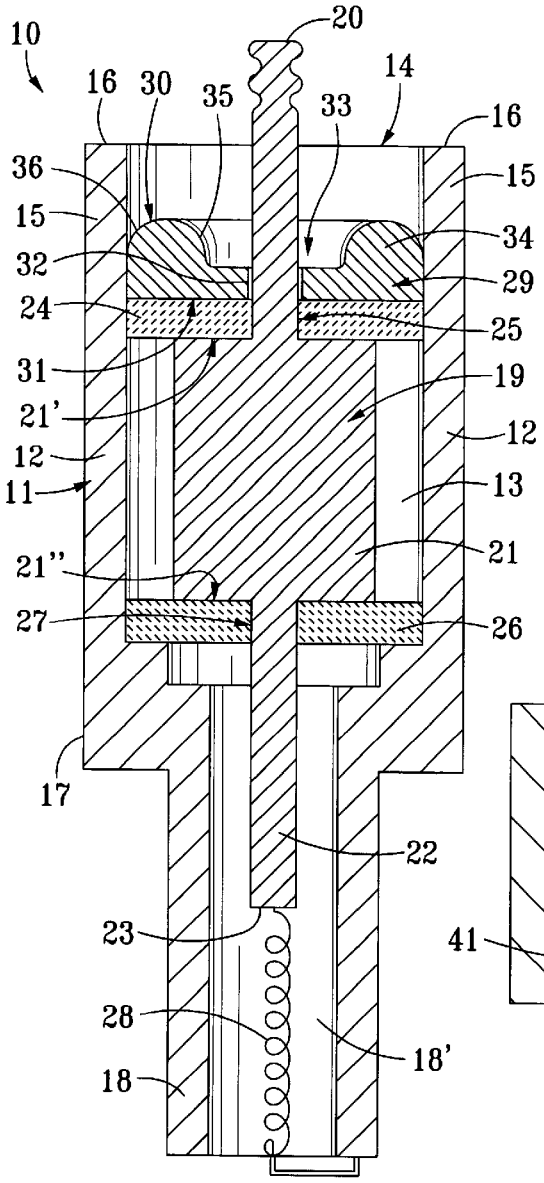
FIG. 1
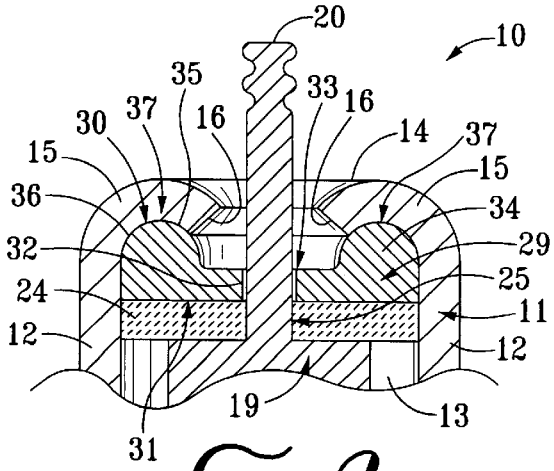
FIG. 2
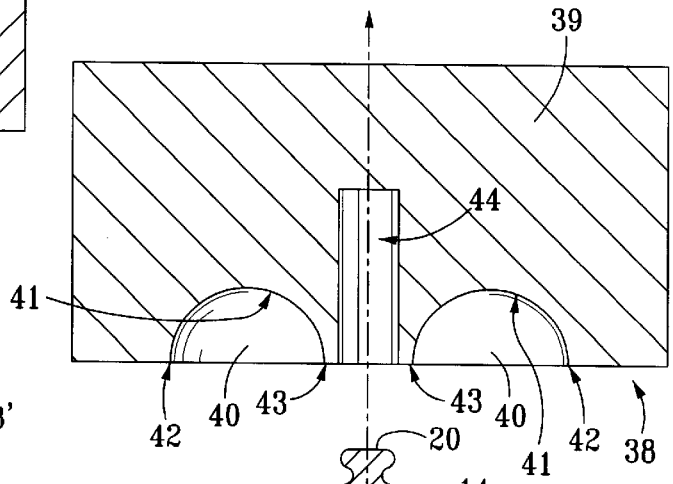
FIG. 3
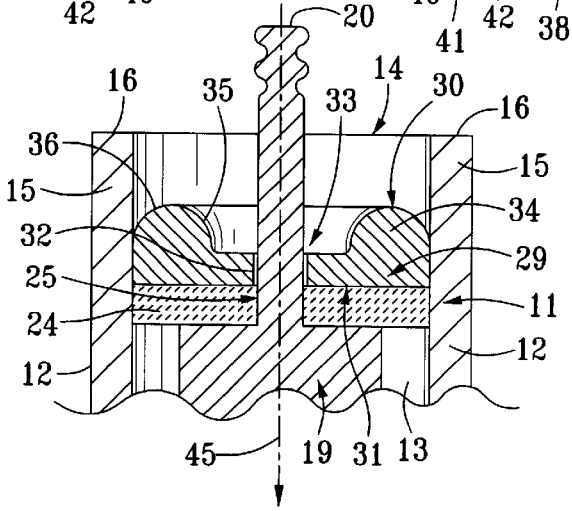

GLOW PLUG WITH CRIMP-SECURED WASHER AND METHOD

BACKGROUND OF THE INVENTION

The field of the invention generally pertains to ignition devices for use with internal combustion engines. The invention relates more particularly to a glow plug construction utilizing an annular washer having a curvilinear upper surface, wherein the annular washer is secured inside the glow plug by crimping an upper rim of the glow plug body to contact and press upon a substantial portion of the curvilinear upper surface of the annular washer.

It is known for diesel and other spark-less internal combustion engines, such as those used for miniature radio-controlled models, to utilize a preheating device whereby the temperature is raised sufficiently to ignite a pressurized combustion chamber and initiate the engine cycle. Due to the high temperatures and pressures necessary for proper operation of these types of engines, it is critical that such preheating devices, commonly known as "glow plugs", are adequately sealed to prevent pressure leakage therethrough. Oftentimes, however, leakage may occur through the electrically insulating seals separating two electrodes which provide electricity to a heating element of the glow plug. This can cause the engine to run lean and consequently damage the engine.

One known method for internally sealing glow plugs has been to crimp, i.e. plastically bend, an upper rim of an outer shell of the glow plug in a radially inward manner to exert pressure on the insular seals. Metallic washers are typically utilized as an intermediate element between the crimp and the insular seals to provide additional contact pressure which arises from thermal expansion of the metal. Additionally, for many glow plug configurations having a coaxial electrode arrangement, crimping operates to firmly secure a core electrode within an outer shell electrode.

For example, in U.S. Pat. No. 4,418,661, a glow plug is shown having a metallic pressure ring 40 placed on an incline or chamfered edge 39 of an insulating bushing 36. The upper end of the outer socket 11 is then rolled or bent over as seen at 41 to press-secure the metallic pressure ring 40 against the insulating bushing 36.

Additionally, in U.S. Pat. No. 4,437,440, a preheating device is shown having an upper end with a top end portion 12 contouredly bent around a metal packing 14 in contact with an electric insulated annular plug 13. As can be best seen in FIG. 1B, the metal packing 14 has a rounded outer edge, and the top end portion 12 is bent at most ninety degrees from vertical around the metal packing 14.

And similar to the '440 patent, a glow plug is shown in FIG. 1 of U.S. Pat. No. 5,834,736 having a top end portion countouredly bent to secure an electrical insulator 31 having a rounded outer edge. The crimped portion of the top end portion is also at most ninety degrees from vertical around the electrical insulator 31.

While crimping alone, or in conjunction with a metallic washer, operates to provide some pressure for internally sealing glow plugs, the ultimate configuration of the crimp as well as the manner in which the crimp is formed, often determines how well the glow plug is actually sealed. In this regard, the crimping portions 47 shown in the '661 patent may experience high localized stresses when crimped at such a sharp angle shown in FIG. 1. This may reduce the life cycle of the glow plug by failing along the crimp angle.

Furthermore, the necessary impact force required to produce and thereafter consistently maintain the crimp at such sharp angles has been known to distort and warp the plug body. Such impact forces are typically adjusted to a greater magnitude to compensate for a limited resilient-rebounding effect of the crimping portions subsequent to crimping. Thus, it would be advantageous in a glow plug crimping process to crimp glow plugs without exerting an impact force thereon.

Additionally, while both the '440 and '736 patents disclose crimp portions contoured to respective curvilinear surfaces, they are angled at most ninety degrees from vertical. The degree of surface contact resulting from this arrangement, however, may be inadequate to supply the necessary crimping pressure to effectively internally seal the glow plug.

BRIEF SUMMARY OF THE INVENTION

It is an object of the present invention to provide a glow plug construction internally pressure sealed to prevent pressure leakage therethrough.

It is a further object of the present invention to provide a glow plug construction which utilizes a metallic washer having a curvilinear upper surface against which a crimp portion of the glow plug substantially contacts for exerting substantial contact pressure thereon.

It is a still further object of the present invention to provide a glow plug construction wherein, upon crimping a crimp portion of the glow plug around a metallic washer having a curvilinear upper surface, an end portion of the crimp portion extends past and below an apex of the upper surface.

It is a still further object of the present invention to provide a crimping method for internally pressure sealing a glow plug construction to prevent pressure leakage therethrough.

It is a still further object of the present invention to provide a crimping method for crimping a crimp portion of a glow plug construction to substantially contact a metallic washer having a curvilinear upper surface for exerting substantial contact pressure thereon.

It is a still further object of the present invention to provide a crimping method wherein upon crimping a crimp portion of the glow plug around a metallic washer having a curvilinear upper surface, an end portion of the crimp portion extends past and below an apex of the upper surface.

The present invention is for a glow plug construction for use in internal combustion engines. The glow plug construction comprises a first electrode which is an outer shell having a central bore, and an upper surface with a crimp portion extending to an upper rim terminus. The glow plug construction also comprises a second electrode which is an elongated rod-like core extending through the open upper end into the central bore of the outer shell. The rod-like core is spaced from and supported against the outer shell by at least an insulating upper support element which is positioned adjacent the open upper end of the outer shell. Heater means is electrically connected to the first and second electrodes for producing heat when electricity is passed therethrough. And the glow plug construction has an annular washer having opposing upper and lower washer surfaces surrounding a central aperture. The upper washer surface has a perimetric ridge portion with a convex radial cross-section. In a preferred embodiment, the upper washer surface also has an annular deck portion adjacent the central aperture and surrounded by the perimetric ridge portion. The annular washer is positioned in the central bore at the open upper end such that the lower washer surface abuts against the upper support element, and the rod-like core non-tactually extends through the central aperture of the annular washer. The crimp portion of the outer shell is crimped radially inward to abut against a substantial portion of the perimetric ridge portion of the annular washer, such that the upper rim terminus is extended past and below an apex of the perimetric ridge portion.

The present invention is also for a crimping method for producing the glow plug construction described above. The method comprises providing a partially-assembled glow plug construction with a yet unbent crimp portion, and providing a crimping die having an annular die cavity with a die surface radially extending between inner and outer die rims. The annular die cavity has a concave radial cross-section greater than and generally proportional to the convex radial cross-section of the perimetric ridge portion of the annular washer. The crimp portion of the outer shell is then aligned with the die surface of the annular die cavity at the outer die rim, such that the crimp portion may slidably contact the die surface at the outer die rim when entering the annular die cavity. Then the partially-assembled glow plug and the crimping die are moved relative to and towards each other along a longitudinal axis of the glow plug, such that the crimp portion of the outer shell is bent radially inward by the die surface to abut the crimp portion against the perimetric ridge portion of the annular washer. And finally, the relative movement is stopped when the upper rim terminus extends at least past and below an apex of the upper washer surface.

BRIEF DESCRIPTION OF THE DRAWINGS

FIG. 1 is a cross-sectional view of the glow plug construction prior to crimping the crimp portion around the annular washer.

FIG. 2 is a cross-sectional view of an upper portion of the glow plug construction finally assembled.

FIG. 3 is a cross-sectional view of the upper portion of the glow plug construction similar to FIG. 1, shown in relation to a crimping die used in the crimping process.

DESCRIPTION OF THE PREFERRED EMBODIMENTS

Figure 4:
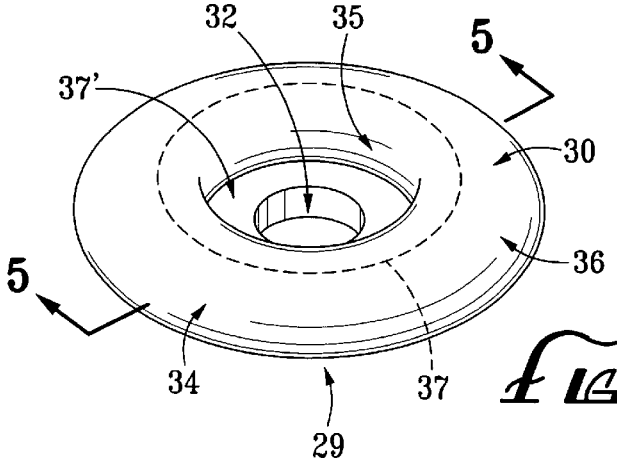
FIG. 4 is a perspective view of the annular washer alone.

Referring now to the drawings, FIGS. 1–3 show the glow plug construction, generally indicated at reference character 10. FIG. 1 shows a cross-sectional view of the entire glow plug construction 10 prior to crimping. The glow plug construction 10 comprises an electrically conductive rigid outer shell, generally indicated at reference character 11, and preferably made of a metallic material such as steel. Furthermore, the outer shell 11 has a preferably cylindrical configuration with a sidewall 12 surrounding a central bore 13, and an open upper end 14 leading into the central bore 13. The outer shell 11 also has a crimp portion 15 extending to an upper rim terminus 16 at the open upper end 14. As can be seen in the figures, the crimp portion 15 is preferably a coextensive end portion of the cylindrical sidewall 12. As best shown in FIG. 1, the outer shell 11 has a lower end 17 and an extension portion 18 extending below the lower end 17. It is notable that while the extension portion 18 shown in FIG. 1 is integrally connected to the lower end 17, other embodiments are also contemplated. For example, the extension portion 18 may be a separate ceramic heater element, known in the relevant art, connected to the outer shell 11 at the lower end 17. In any case, the extension portion 18 shown in FIG. 1 functions to surround and protect the heater element 28, as will be discussed in detail below.

As can be best seen in FIG. 1, the glow plug construction 10 further comprises a second electrode which is a rod-like core 19. The rod-like core 19 coaxially extends through the open upper end 14 of the outer shell 11, i.e. first electrode, and into the central bore 13 of the outer shell 11. The rod-like core 19 has a center portion 21 positioned within the central bore 13 of the outer casing 11, an upper post portion 20 extending above the center portion 21 beyond the open upper end 14, and a lower portion 22 extending below the center portion 21 and partially into a heating area 18' surrounded by the extension portion 18 of the outer casing 11. As shown in FIG. 1, the center portion 21 of the rod-like core 19 preferably has a substantially larger diameter than the upper post portion 20 or the lower portion 22. The relatively wider diameter of the center portion 21 provides abutment surfaces 21' and 21" by which the rod-like core 19 is secured within the central bore 13 of the outer shell 11, as will be discussed next.

As can be seen again in FIG. 1, the rod-like core 19 is spaced from and supported against the sidewall 12 of the outer shell 11 by insulating support means 24, 26. The insulating support means preferably comprises an upper support portion 24 positioned adjacent the open upper end 14 of the outer shell and abutting the upper abutment surface 21' of the center portion 21. It has a central aperture 25 through which the upper post portion 20 of the rod-like core 19 extends. Similarly, a lower support portion 26 supports the rod-like core 19 at the lower end 17 of the outer shell 11. Like the upper support portion 24, the lower support portion 26 has a central aperture 27 through which the lower portion 22 of the rod-like core 19 extends, and abuts against the lower abutment surface 21" of the center portion 21. As can be seen in FIG. 1, both the upper and lower support portions 24, 26 of the insulating support means spaces the wider center portion 21 of the rod-like core 19 from the sidewall 12 of the outer shell 11. Because both the outer shell 11 and the rod-like core 19 are first and second electrodes, they must be at all times separated to prevent short circuiting the system. It is notable that the clearance between the rod-like core 19 and the outer shell 11 will depend on the voltage requirements of the glow plug application. For relatively low voltage systems, such as radio controlled model engine applications with a typical voltage of 1.5 volts, the clearance between the rod-like core 19 and the outer shell 11 may be small, e.g. within the range of several thousandths of an inch. It is contemplated for applications in full-size motor vehicles utilizing higher voltages that the center portion 21 of the rod-like core 19 will be sufficiently spaced from the sidewall of the outer casing 11 to prevent arcing therebetween.

The outer shell 11 and the rod-like core 19 serve as first and second electrodes, respectively, to supply an electric current through heater means 28 electrically connected to the first and second electrodes, 11, 19. The heater means 28 is preferably of a resistor type which generates heat when electricity is passed therethrough by the first and second electrodes 11, 19. As shown in FIG. 1, the heater means is preferably a heater coil 28 located in the heating area 18' within the extension portion 18, and is electrically connected to both a lower tip 23 of the lower portion 22 of the rod-like core 19 and the extension portion 18. It is notable that the heater means 28 may have various different embodiments not exclusive to the heater coil 28 shown in FIG. 1. The heater means is preferably composed of a metallic material. And preferably, when used in model engine applications, a platinum, iridium, and rhodium alloy is utilized. Alternatively, it is also known and contemplated to construct the heat generating element from a nonmetallic resistor-type material, such as a ceramic, when utilized for full-sized engine applications.

Figure 5:
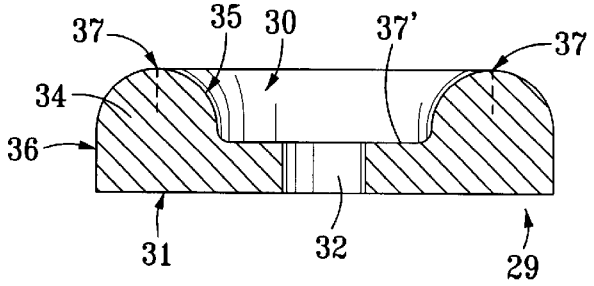
FIG. 5 is a cross-sectional view taken along line 5—5 of FIG. 4.
Figure 6A:
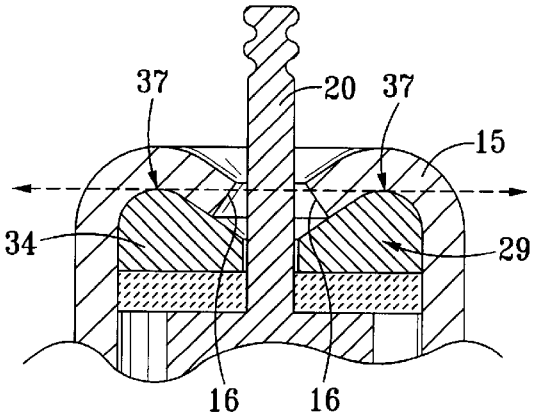
FIG. 6A is a cross-sectional view of the upper portion of the glow plug construction utilizing a first alternative embodiment of the annular washer.

As can be seen in the figures, the glow plug construction 10 also comprises an annular washer, generally indicated at reference character 29. As can be best seen in FIG. 4, showing a perspective view of the annular washer 29 alone, the annular washer 29 has a generally annular disk configuration with a central aperture 32, an upper washer surface 30, and a lower washer surface 31 (shown in FIG. 5). In FIGS. 4 and 5, the upper washer surface 30 is shown having a perimetric ridge portion 34 along the outer perimeter of the annular washer 29. As shown in FIG. 5, the perimetric ridge portion 34 has a convex radial cross-section. And in a preferred embodiment, the convex radial cross-section of the perimetric ridge portion 34 is convex-curvilinear. In any case, the annular washer 29 has an apex 37, depicted as an apex ring 37 in FIG. 4. The upper washer surface 30 of the annular washer 29 may be partially or substantially comprised of the perimetric ridge portion 34 as shown in FIGS. 1–5, or alternatively comprised entirely of the perimetric ridge portion 34 as shown by a first alternative embodiment in FIG. 6A. In the preferred embodiment shown in FIGS. 1–5, an annular deck 37' separates the perimetric ridge portion 34 from the central aperture 32. The annular deck 37' and the resulting gap between the central aperture 32 and the perimetric ridge portion 34 is particularly beneficial during the crimping process, for achieving a crimp greater than ninety-degrees from vertical (see discussion below).

Figure 6B:
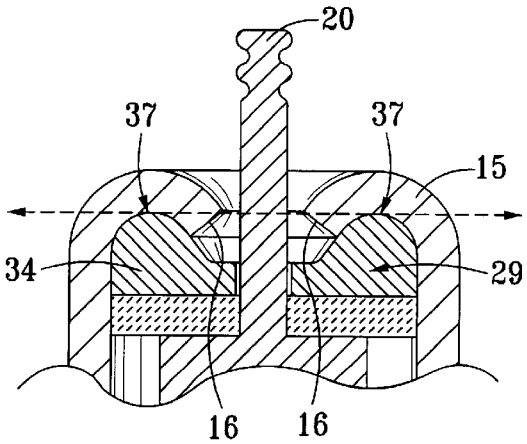
FIG. 6B is a cross-sectional view of the upper portion of the glow plug construction illustrating a second alternative embodiment of the annular washer.

Furthermore, as can best be seen in FIGS. 4 and 5, the perimetric ridge portion 34 preferably comprises radially inner and outer ridge sections, 35 and 36, respectively. Preferably, the radial outer ridge section 36 has a convex-curvilinear radial cross-section which enables the crimping portion 15 of the outer shell 11 to contour therearound. Preferably still, the radially inner ridge section 35 may also have a convex-curvilinear radial cross-section which is continuous with the radially outer ridge section 36. It is notable, however, that the inner ridge section 35 need not have a curvilinear configuration to achieve the hook-like crimp formation; as shown in FIG. 6B, the inner ridge section may have a straight line cross-section. However, it is further notable, that this embodiment may produce localized stresses along the crimp portion 15 at the apex 37 of the upper washer surface 30.

As can be seen in FIGS. 1, 2, and 3, the annular washer 29 is positioned in the central bore 13 at the open upper end 14 of the outer shell 11. In this manner, the lower washer surface 31 abuts against the upper support portion 24 of the insulating support means, and the rod-like core 19 non-tactually extends through the central aperture 25 of the annular washer 29. The annular washer 29 may have a diameter equal to that of the inner surface of the sidewall 12 of the outer shell 11 to provide a snug fit. Additionally, the annular washer 29 is seated within the central bore 13 sufficiently below the upper rim terminus 16 of the crimp portion 15 such that the upper rim terminus 16 may wrap around the perimetric ridge portion 34 to extend past and below the apex 37.

As can be seen in FIG. 2, showing an upper portion of the finally assembled glow plug construction 10, the crimp portion 15 of the outer shell 11 is crimped, i.e. plastically bent, around the perimetric ridge portion 34 of the annular washer 29. In particular, the upper rim terminus 16 extends past and below the apex 37 of the perimetric ridge portion 34 in a hook-like configuration. In this regard, the annular deck portion 37', which preferably spaces the perimetric ridge portion 34 from the central aperture 32, enables the upper rim terminus 16 to extend sufficiently between the inner ridge section 35 and the upper post portion 20 of the rod-like core 19. Consequently, this final hook-like formation of the crimp portion 15 enables contact with a substantially greater portion of the upper washer surface 30 of the annular washer 29. This arrangement may in turn produce greater crimp pressure against the annular washer 29 as well as greater sealing pressure against the upper and lower support portions 24 and 26. Moreover, the curvilinear perimetric ridge portion 34 of the annular washer 29 serves as a rigid template, whereby the crimp portion 15 is contoured to the perimetric ridge portion 34 by means of a non-impacting force, e.g. hydraulic force (see detailed discussion below). And furthermore, while not wishing to be bound by any theory, the hook-shape of the crimp portion 15 may enable greater retention of its shape when internal back pressures are exerted thereagainst, typically from thermal expansion of the metallic annular washer 29 or compression and combustion pressures within the combustion chamber. It is notable that the metallic annular washer 29, which is preferably brass, undergoes thermal expansion during operation of the glow plug which provides additional pressure against the crimp portion 15 to produce a better seal.

FIG. 3 shows the glow plug construction utilized in a method for producing the crimp over the annular washer 29. Initially, a partially assembled glow plug construction 10 is provided, similar to that shown in FIG. 1. The partially assembled glow plug construction has the annular washer 29 seated within the central bore 13 at the open upper end 14, and the crimp portion 15 of the outer shell 11 is yet unbent around the annular washer 29.

Furthermore, a crimping die 38 is provided comprising a die block 39. On a lower face of the die block 39 is an annular die cavity 40, having a die surface 41 radially extending between an inner die rim 43 and an outer die rim 42. As shown in FIG. 3, the annular die cavity 40 has a concave radial cross-section greater than and generally proportional to the convex radial cross-section of the perimetric ridge portion 34 of the annular washer 29. Additionally, a post cavity 44 is centered on the die block 39 for receiving the upper post portion 20 of the rod-like core 19. It is notable that the crimping die 38 is preferably composed of a sufficiently hard tool material, with the die cavity 40 and post cavity 44 formed by known manufacturing processes, such as EDM machining.

Next, the partially assembled glow plug construction is aligned with the die block 39 such that the crimp portion 15 of the outer shell 11 aligns it with the die surface 41 of the annular die cavity 40 at the outer die rim 42. In this manner, the correct alignment allows the crimp portion 15 to slidably contact the die surface 41 at the outer die rim 42 when entering the annular die cavity 40.

The partially assembled glow plug 10 and the crimping die 38 are then moved relative to and towards each other along the longitudinal access 45 of the glow plug 10. The impact force is typically required. In doing so, the crimp portion 15 of the outer shell 11 is bent inward by the die surface 41 to abut the crimp portion 15 against the perimetric ridge portion 34 of the annular washer 29. It is notable that the spacing provided by the preferred annular deck portion 37' of the annular washer 29 enables the inner die rim portion 43 of the die block 39 to sufficiently extend into the gap together with the upper rim terminus 16, in producing the hook-like final formation of the crimp portion 15. Absence or reduction of the annular deck portion 37' may thus impair the ability of the crimping die 38 to produce the hook-like formation.

And finally, the relative movement is stopped when the upper rim terminus 16 of the crimp portion 15 extends at least past and below the apex 37 of the upper washer surface 30. The movement thus described is preferably a gradual movement produced by, for example, a hydraulic press. Such a movement gradually bends the crimp portion 15 to contour about the perimetric ridge portion 34. Furthermore, the crimping force resulting from the gradual movement is sufficient to extend the upper rim terminus 16 at least past and below the apex 37 of the upper washer surface. It is notable that accelerated movements which produce an impact crimping force may cause the glow plug body, e.g. the outer shell 11, to warp or otherwise become damaged.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A glow plug construction for use in an internal combustion engine, said glow plug construction comprising:

a first electrode being an outer shell having an open upper end leading into a central bore, and a crimp portion extending to an upper rim terminus at said open upper end;

a second electrode being a rod-like core extending through said open upper end into said central bore of said outer shell, said rod-like core spaced from and supported against said outer shell by insulating support means having an upper support portion adjacent said open upper end of said outer shell;

heater means electrically connected to said first and second electrodes whereby heat is generated upon electricity passing therethrough; and an annular washer having opposing upper and lower washer surfaces surrounding a central aperture, said upper washer surface having a perimetric ridge portion with a convex radial cross-section, said annular washer positioned in said central bore at said open upper end of said outer shell such that said lower washer surface abuts against said upper support portion of said insulating support means and said rod-like core non-tactually extends through said central aperture of said annular washer, wherein said crimp portion of said outer shell is crimped radially inward to abut against said perimetric ridge portion of said annular washer, and said upper rim terminus is extended past and below an apex of said perimetric ridge portion.

2. The glow plug construction as in claim 1, wherein said perimetric ridge portion has radially inner and outer ridge sections, said radially outer ridge section having a convex-curvilinear radial cross-section.

3. The glow plug construction as in claim 2, wherein said radially inner ridge section of said perimetric ridge portion has a convex-curvilinear radial cross-section which is continuous with said radially outer ridge section.

4. The glow plug construction as in claim 1, wherein said upper washer surface of said annular washer has an annular deck portion adjacent said central aperture and surrounded by said perimetric ridge portion, whereby said perimetric ridge portion is spaced from said central aperture.

5. The glow plug construction as in claim 1, wherein said annular washer is composed of brass.

6. A glow plug construction for use in an internal combustion engine, said glow plug construction comprising:

a first electrode being an outer shell having an open upper end leading into a central bore, and a crimp portion extending to an upper rim terminus at said open upper end;

a second electrode being a rod-like core extending through said open upper end into said central bore of said outer shell, said rod-like core spaced from and supported against said outer shell by insulating support means having an upper support portion adjacent said open upper end of said outer shell;

heater means electrically connected to said first and second electrodes whereby heat is generated upon electricity passing therethrough; and an annular washer having opposing upper and lower washer surfaces surrounding a central aperture, said upper washer surface having an annular deck portion adjacent said central aperture, and a perimetric ridge portion with a convex-curvilinear radial cross-section surrounding said annular deck portion, said annular washer positioned in said central bore at said open upper end of said outer shell such that said lower washer surface abuts against said upper support portion of said insulating support means and said rod-like core non-tactually extends through said central aperture of said annular washer, wherein said crimp portion of said outer shell is crimped radially inward to abut against said perimetric ridge portion of said annular washer.

7. The glow plug construction as in claim 6, wherein said upper rim terminus is extended past and below an apex of said perimetric ridge portion.

8. The glow plug construction as in claim 6, wherein said annular washer is composed of brass.

9. A crimping method for glow plugs comprising the steps of:

providing a partially-assembled glow plug comprising an outer shell having an open upper end leading into a central bore, and a crimp portion with an upper rim terminus at said open upper end; a rod-like core extending through said open upper end into said central bore of said outer shell, said rod-like core spaced from and supported against said outer shell by insulating support means having an upper support portion adjacent said open upper end of said outer shell; and an annular washer having opposing upper and lower washer surfaces surrounding a central aperture, said upper washer surface having a perimetric ridge portion with a convex radial cross-section, and said annular washer positioned in said central bore at said open upper end of said outer shell such that said lower washer surface abuts against said upper support portion of said insulating support means and said rod-like core non-tactually extends through said central aperture of said annular washer;

providing a crimping die having an annular die cavity with a die surface radially extending between inner and outer die rims, said annular die cavity having a concave radial cross-section greater than and generally proportional to the convex radial cross-section of said perimetric ridge portion of said annular washer;

aligning said crimp portion of said outer shell with said die surface of said annular die cavity at said outer die rim, whereby said crimp portion may slidably contact said die surface at said outer die rim when entering said annular die cavity;

moving said partially-assembled glow plug and said crimping die relative to and towards each other along a longitudinal axis of said glow plug, whereby said crimp portion of said outer shell is bent radially inward by said die surface to abut said crimp portion against said perimetric ridge portion of said annular washer; and stopping said movement upon said upper rim terminus extending at least past and below an apex of said upper washer surface.

10. The crimping method as in claim 9, wherein the step of moving said partially assembled glow plug and said crimping die towards each other is by gradually moving said partially-assembled glow plug and said crimping die relative to and towards each other by a non-impacting crimping force.

* * * * *